US006628182B1

(12) United States Patent
Oldfield

(10) Patent No.: US 6,628,182 B1
(45) Date of Patent: Sep. 30, 2003

(54) RIGHT ANGLE COAXIAL CABLE CONNECTIONS TO MICROWAVE COMPONENTS ON A CARRIER

(75) Inventor: William W. Oldfield, Redwood City, CA (US)

(73) Assignee: Anritsu Company, Morgan Hill, CA (US)

( * ) Notice: Subject to any disclaimer, the term of this patent is extended or adjusted under 35 U.S.C. 154(b) by 18 days.

(21) Appl. No.: 09/656,042

(22) Filed: Sep. 8, 2000

Related U.S. Application Data

(60) Provisional application No. 60/178,201, filed on Jan. 26, 2000.

(51) Int. Cl.[7] ..... H01P 1/04

(52) U.S. Cl. ..... 333/247; 333/260; 439/578

(58) Field of Search ..... 333/260, 255, 333/33, 247; 439/578, 582

(56) References Cited

U.S. PATENT DOCUMENTS 5,123,863 A * 6/1992 Frederick et al. ..... 439/578
5,570,068 A * 10/1996 Quan ..... 333/33
5,795,162 A * 8/1998 Lambert ..... 333/260 X
5,797,765 A * 8/1998 Barnett et al. ..... 333/260 X
6,292,073 B1 * 9/2001 Egolf ..... 333/260

FOREIGN PATENT DOCUMENTS

JP 96002 * 4/1991 ..... 333/33

* cited by examiner

*Primary Examiner*—Benny Lee
(74) *Attorney, Agent, or Firm*—Fliesler Dubb Meyer & Lovejoy LLP

(57) ABSTRACT

A microwave circuit connection method allows many coaxial cable connections between the outside world and microwave circuit components mounted on a carrier in a housing. A coaxial cable 32 extends through a sleeve 30, which is contained within the housing 1. A bore is provided through the carrier 2 for the coaxial cable 32 and is counterbored to form first and second bores 37 and 40 with different diameters. The dielectric 34 provided within the coaxial cable 32 extends through the first bore 37. The dielectric 34 is removed so that a center conductor 36 of the coaxial cable 32 extends through the second bore 40 to a point adjacent the MMIC 10 mounted to the carrier. An air dielectric section is thus formed in the second bore 40. The center conductor 36 of the coaxial cable 32 is attached, using a ribbon bonding cable 42, to an MMIC 10 mounted on the carrier 2.

9 Claims, 5 Drawing Sheets

RIGHT ANGLE COAXIAL CABLE CONNECTIONS TO MICROWAVE COMPONENTS ON A CARRIER

CROSS-REFERENCE TO PROVISIONAL APPLICATION

This Patent Application claims the benefit of Provisional Application No. 60/178,201 filed Jan. 26, 2000.

FIELD OF INVENTION

This invention relates generally to the mounting of microwave circuits in housings. More particularly, the present invention relates to making right angle microwave connections to the housing to supply signals to microwave circuits on a carrier.

BACKGROUND OF THE INVENTION

Typically many microwave circuits or individual components make up a subsystem enclosed within a single housing. The components may include amplifiers, couplers, switches, detectors, transmission lines, matching circuits or MMICs which may include any or all of the proceeding. Most of these components must be mounted to ground. Such mounting can be accomplished using solder or conductive epoxy to attach the components to the metal housing.

It may also be desired to mount individual components, or a small group of components or MMICs, on a metal carrier to provide the ground. A carrier is a thin piece of metal, typically ½ to 1 mm thick, which provides the ground for the circuits. An undesirable feature with carriers is that at high frequencies, such as microwave frequencies, the ground normally formed by the thickness of the carrier at lower frequencies provides an electrical discontinuity that can approach a full reflection at millimeter wave frequencies if full contact is not maintained between the carrier and housing.

Carriers which can provide grounding at high frequencies become more desirable with the increasing availability of MMIC subsystems. If a number of MMICs are mounted directly onto a housing and one of them fails, the entire assembly must be discarded, as it is generally impossible to remove a fragile MMIC after it has been mounted without destroying other MMICs in the vicinity. However, a carrier can be mechanically placed in and removed from the housing without destroying the circuit components mounted on it.

Once circuit components are mounted on a carrier, it is necessary to make connections between the carrier and the outside world. This is frequently accomplished using a coaxial connector. It is critical to maintain a good ground between the outer conductor of the coaxial cable supplying a signal to the coaxial connector and the carrier. It is also desirable to minimize the area required to make a connection between the coaxial cable and the carrier. However, as shown in FIG. 1A, a standard coaxial cable connector 4 occupies a large area.

SUMMARY OF THE INVENTION

In accordance with the present invention, a coaxial cable right angle connection is used to make a high-frequency electrical connection between microwave integrated circuit components in a housing and the outside world. A carrier is mounted within the housing, and provides grounding for attached microwave components. A coaxial cable extends through a sleeve, which is contained within the housing. The sleeve is soldered to the coaxial cable and is maintained against the carrier using an axial screw, thereby assuring good grounding from the outer conductor of the coaxial cable to the carrier. A bore is provided through the carrier for the coaxial cable and is counterbored to form first and second bores with different diameters. The outer conductor of the coaxial cable is removed for insertion through the carrier and the dielectric provided within the coaxial cable extends through the first bore in the carrier. A center conductor of the coaxial cable extends through both bores in the carrier to a point adjacent microwave components mounted on the carrier. The dielectric of the coaxial cable is removed so that the center conductor alone extends through a portion of the second bore to form an air dielectric section. The center conductor of the coaxial cable can be attached to microwave components mounted to the carrier using ribbon bonding.

BRIEF DESCRIPTION OF THE DRAWINGS

The invention will be described with respect to particular embodiments thereof, and reference will be made to the drawings, in which.

DETAILED DESCRIPTION OF THE PRESENT INVENTION

Figure 1A:
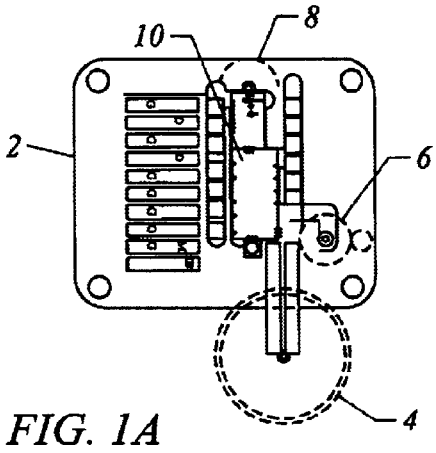
FIG. 1A shows a top view of a system in accordance with the present invention.
Figure 1B:
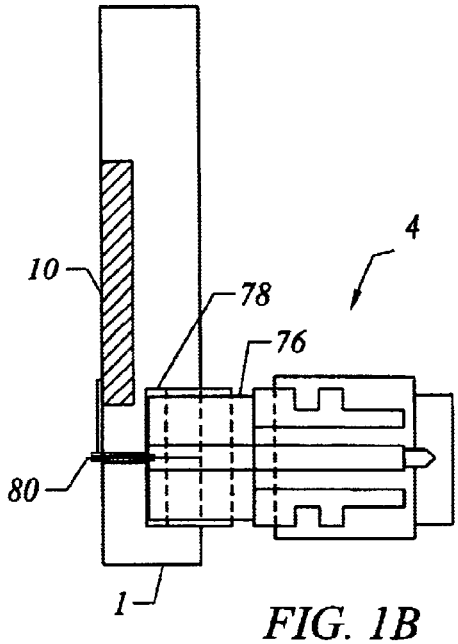
FIG. 1B shows a partial front view of a system in accordance with the present invention.
Figure 1C:
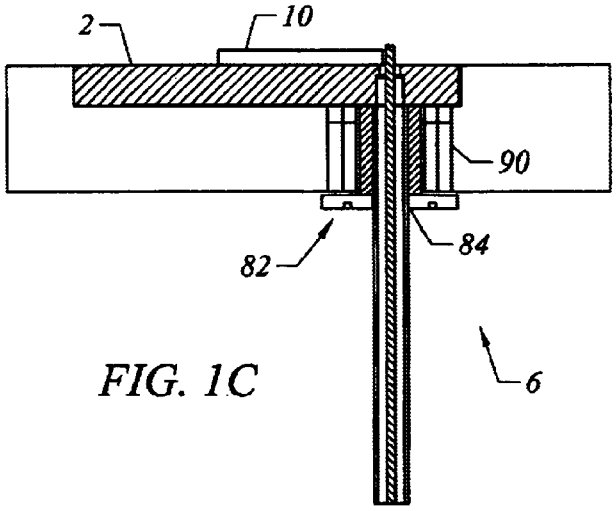
FIG. 1C shows a partial side view of a system in accordance with the present invention.

FIGS. 1A, 1B and 1C show top, partial front and partial side views of a system in accordance with the present invention. The system shown in top view in FIG. 1A includes a housing 1 with one carrier 2 and three RF connections 4, 6 and 8 to the outside world. There are two right angle coaxial cable connections 6 and 8 made in accordance with the present invention, in which the coaxial cable extends through the carrier 2. One standard angle connection 4 is also shown, located away from the carrier 2. The RF connections 4, 6 and 8 provide an electrical connection with a Millimeter Wave Microwave Integrated Circuit MMIC 10 mounted on the carrier 2. The partial side view of FIG. 1B shows details of a large standard angle connector 4, and its connection to the MMIC 10. The standard angle connector 4 includes an outer conductor 76 provided in an opening 78 in the housing 1. A center conductor pin 80 of the connector 4 extends from the housing and is connected to components on the MMIC 10. The partial front view of FIG. 1C shows details of the right angle connector 6 made in accordance with the present invention and its connection to the MMIC 10 provided on the carrier 2 of the housing 1. Details of the connector 6 are described to follow with respect to FIG. 3.

Figure 2:
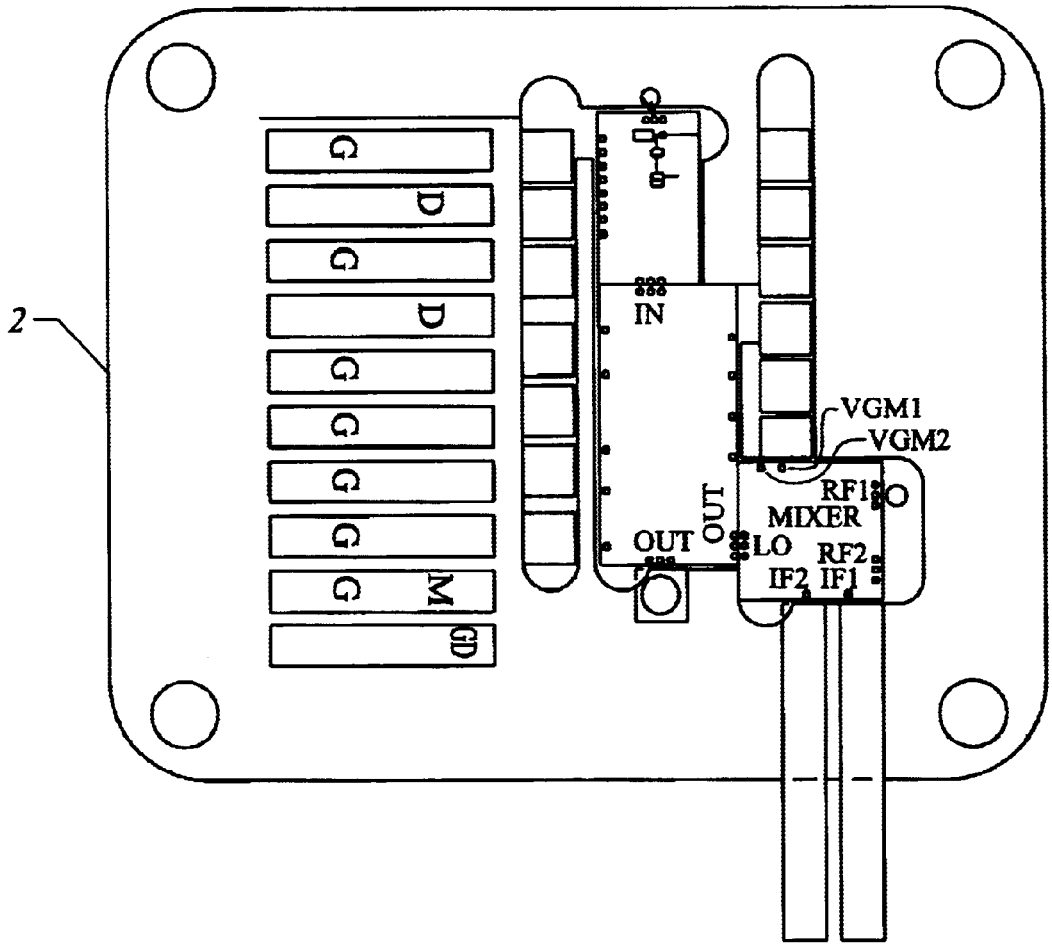
FIG. 2 shows a carrier with circuit components ready to be installed into the housing.
Figure 3:
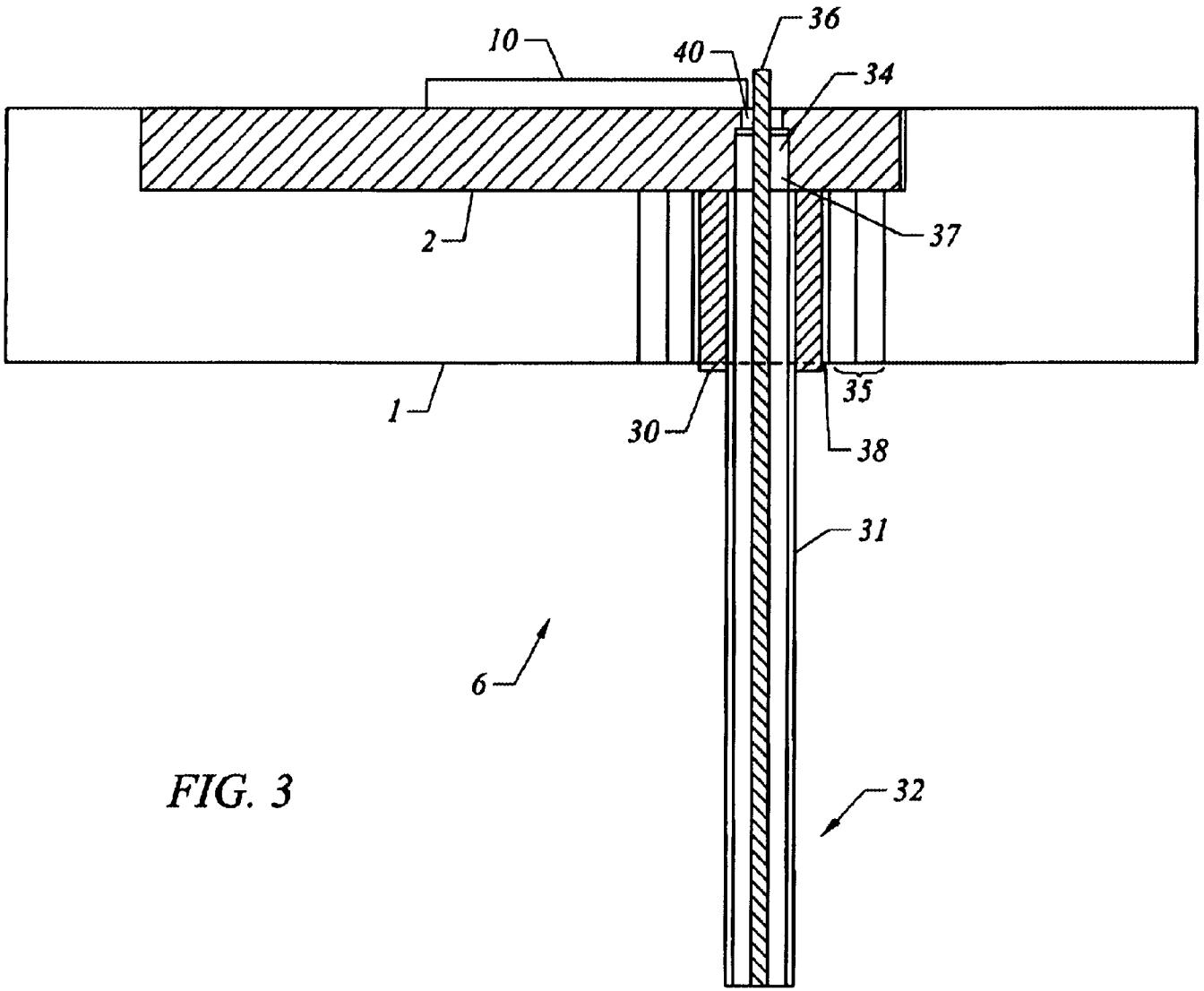
FIG. 3 shows a right angle coaxial cable arranged at a right angle to the carrier in accordance with the present invention.

FIG. 2 shows the carrier 2 with circuit components ready to be installed into the housing. The carrier 2 is shown with MMIC, bypass capacitor, bonding and DC connection substrates in place. All of the critical fine gold wire bonding is also shown. Connections to the outside world from the carrier, however, are not shown. FIG. 3 shows the details of the right angle coaxial cable connection 6 in accordance with the present invention. To form the coaxial cable connection 6, a sleeve 30 is soldered to a coaxial cable 32. The outer conductor 31 of the coaxial cable is trimmed so that part of the dielectric 34 extends past the sleeve 30 and the center conductor 36 extends past the dielectric 34. Typically a small coaxial cable such as a UT 47 is used, since small size is a virtue at high frequencies.

As further shown in FIG. 3, for mounting the coaxial cable assembly connection 6, a hole 38 in the metal housing 1 is made slightly larger than the diameter of the sleeve. A bore is provided through the carrier 2 for the coaxial cable 32 and is counterbored to form first and second bores 37 and 40 with different diameters. The outer conductor 31 of the coaxial cable 32 is removed for insertion through the carrier 2 and the dielectric 34 provided within the coaxial cable 32 extends through the first bore 37 in the carrier. The dielectric 34 is removed so that only the center conductor 36 extends through the second bore 40, thus forming an air dielectric section. The depth and diameter of the second bore 40 are preferably adjusted so that the air dielectric section is 50 ohms. The first bore 37 is deeper than the extended length of the dielectric 34 to provide well-known RF step compensation. The dielectric 34 extending into the first bore 37 further functions to center the center conductor 36 within the second bore 40. The air dielectric section may be eliminated and the dielectric extended to the surface of the housing to provide better support and centering of the center conductor 36, but this would not provide as good an RF match due to the larger size of the second bore 36.

The sleeve 30 is maintained within the housing 1 by the holding means. The holding means may be an axial screw 82 with a hole 84 for the coaxial cable as shown in the front view of FIG. 1C (holes 35 for the axial screw are shown in FIG. 3). The axial screw 82 is provided in an opening 90 of the housing 1. Alternatively, the holding means may be side screws, which are screwed into the housing at a right angle to the sleeve, and which hold the sleeve in place by pressing against it. Either type of screw assures that the critical ground connection is made between the coaxial cable outer conductor 31 and the carrier 2.

As shown in FIG. 3, the center conductor 36 of the coaxial cable 32 can extend above the top of the MMIC 10 to which it will be attached. This forms a capacitive stub which compensates for the inductive length of the center conductor 36 after it leaves the second bore 40 in the carrier 2 and extends to the top of the MMIC 10.

Figure 4:
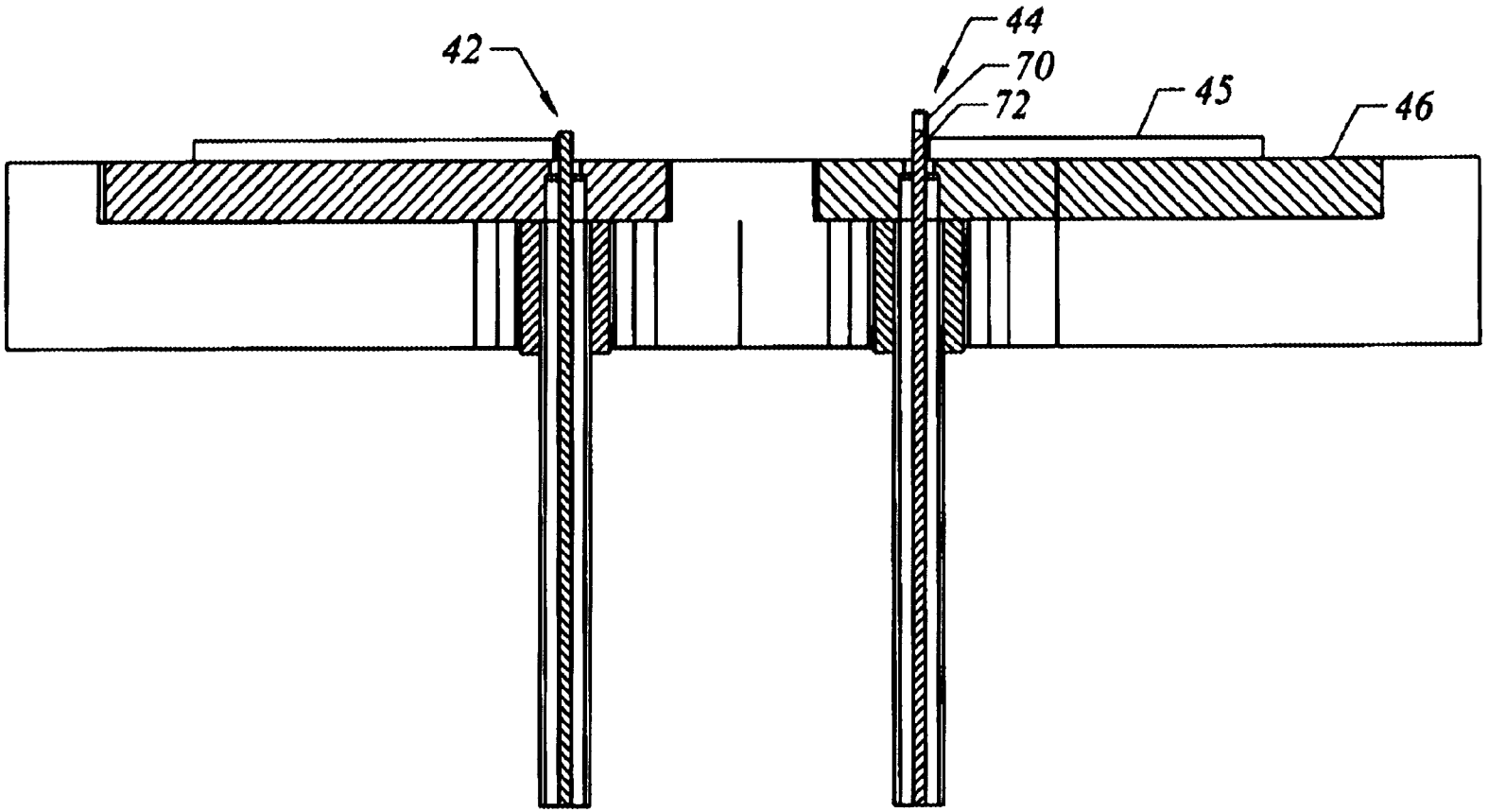
FIG. 4 shows methods for attaching the center conductor of a coaxial cable to microwave circuit components mounted on a carrier.

Attachment methods from coaxial cable center conductors to a microwave circuit component, such as an MMIC, are shown in FIG. 4. The left side is a standard ribbon bond attachment 42. The right side uses a sliding contact 44 to connect the center conductor to an MMIC 45. The sliding contact 44 is a formed piece of gold plate shim stock with a wrapped portion 70 with walls that makes firm spring contact to the center conductor and a tab portion 72 that makes contact with an MMIC 45 on the carrier 46. The sliding contact connection 44 causes minimum inductance in the connection area.

Figure 5:
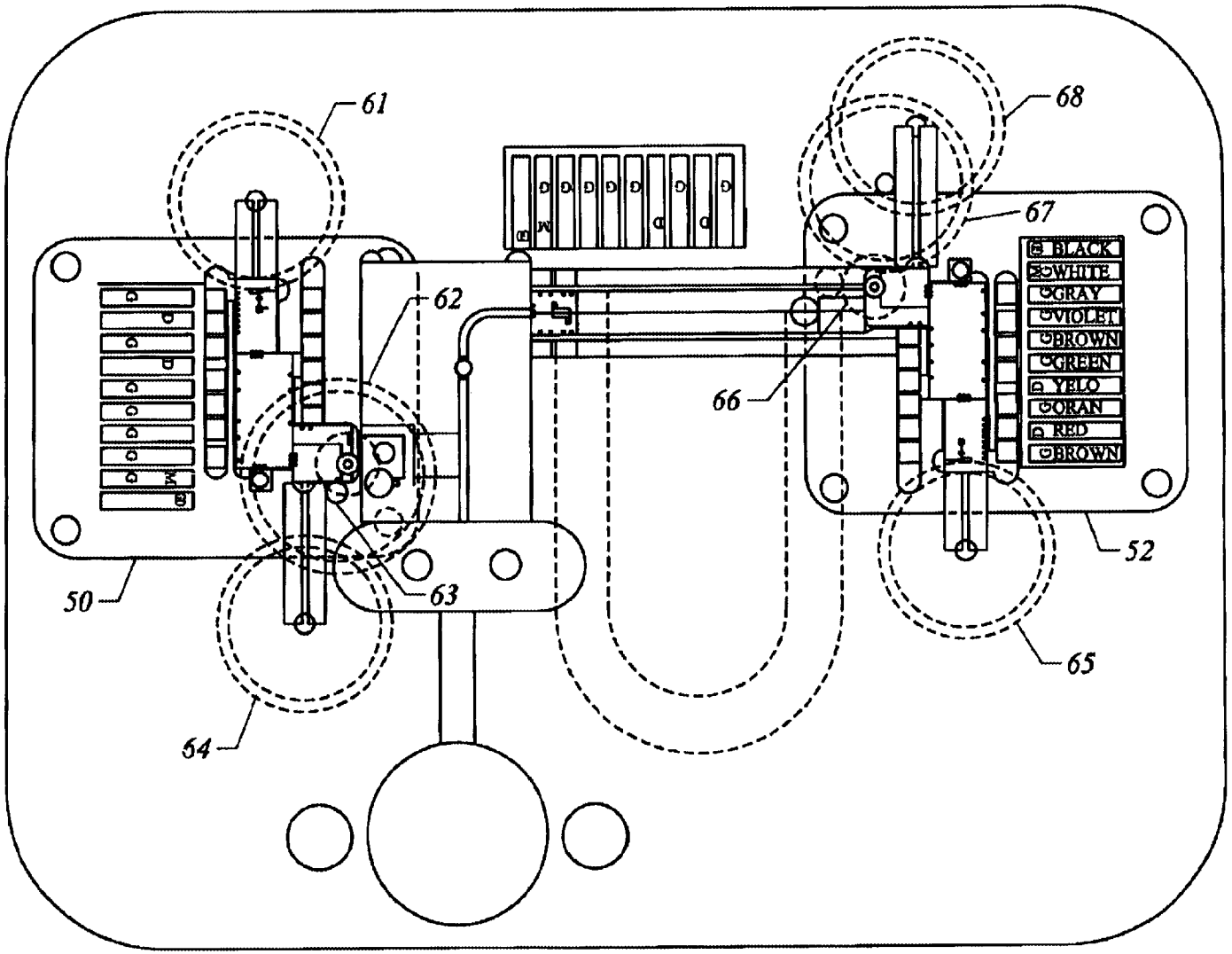
FIG. 5 shows a complex subsystem in accordance with the present invention.

FIG. 5 shows a more complex subsystem in accordance with the present invention with two carriers 50 and 52 and a number of right angle connections 61,62,63,64,65,66,67 and 68 for distributing signals to components on the carriers.

What is claimed is:

1. A coaxial cable connection to a microwave circuit, comprising:

a coaxial cable with a center conductor, an outer conductor and a dielectric between the center and the outer conductor;

a carrier supporting components of the microwave circuit, the carrier containing a first bore and a second counterbore within the first bore;

a housing supporting the carrier with a hole for the coaxial cable provided through the housing; and wherein the dielectric of the coaxial cable extends into the second counterbore separate from the outer conductor and at a right angle to the carrier, and the center conductor of the coaxial cable is coupled to at least a portion of the components of the microwave circuit.

2. The circuit of claim 1, further comprising a sleeve located within the hole of the housing supporting the coaxial cable, the sleeve length extending substantially an entire length of the hole in the housing.

3. The circuit of claim 2, further comprising an axial screw with an opening for the coaxial cable, wherein said axial screw is screwed into the housing in a tapped opening in the housing separate from the hole for supporting the sleeve, the axial screw for contacting the sleeve to maintain the sleeve within the hole of the housing.

4. The circuit of claim 2, in which the sleeve is soldered to the coaxial cable.

5. The circuit of claim 1, wherein the dielectric does not extend through the first bore, so the first bore forms an air dielectric section.

6. The circuit of claim 1, wherein the center conductor of the coaxial cable is coupled to the components of the microwave circuit using a metal plate shim stock, wherein said metal plate shim stock has a wrapped portion and a tab portion, said wrapped portion making a spring contact to the center conductor of the coaxial cable, said wrapped portion having walls extending substantially parallel to the center conductor of the coaxial cable, said walls for spring contacting opposite sides of the center conductor of the coaxial cable, and said tab portion extending substantially perpendicular from the wrapped portion for electrically connecting to a conductor located on the substrate.

7. A coaxial cable connection to a microwave circuit, comprising:

a coaxial cable with a center conductor, an outer conductor and a dielectric between the center and the outer conductor;

a carrier supporting components of the microwave circuit, the carrier containing a hole wherein the dielectric extends only partially through the hole in the carrier;

a housing supporting the carrier with a hole for the coaxial cable provided through the housing; and a sleeve for providing within the hole of the housing, the sleeve length extending substantially an entire length of the hole in the housing, wherein the center conductor of the coaxial cable extends through the hole in the carrier at about a right angle to the carrier, and the center conductor of the coaxial cable is coupled to at least a portion of the components of the microwave circuit.

8. The circuit of claim 7, wherein the center conductor of the coaxial cable is coupled to the components of the microwave circuit using a metal plate shim stock, wherein said metal plate shim stock has a wrapped portion and a tab portion, said wrapped portion making a spring contact to the center conductor of the coaxial cable, said wrapped portion having walls extending substantially parallel to the center conductor of the coaxial cable, said walls for spring contacting opposite sides of the center conductor of the coaxial cable, and said tab portion extending substantially perpendicular from the wrapped portion for electrically connecting to a conductor located on the substrate.

9. The circuit of claim 7, further comprising an axial screw with an opening for the coaxial cable, wherein said axial screw is screwed into the housing in a tapped opening in the housing separate from the hole for supporting the sleeve, the axial screw for contacting the sleeve to maintain the sleeve within the hole of the housing.

* * * * *